US011047620B2

(12) United States Patent
Beutler et al.

(10) Patent No.: US 11,047,620 B2
(45) Date of Patent: Jun. 29, 2021

(54) FREEZE DRYER AND A METHOD FOR INDUCING NUCLEATION IN PRODUCTS

(71) Applicant: GEA LYOPHIL GMBH, Hürth (DE)

(72) Inventors: Thomas Heinrich Ludwig Beutler, Hürth (DE); Marion Böckem, Hürth (DE); Alexey Bauer, Hürth (DE); Carolin Wolf, Hürth (DE)

(73) Assignee: GEA LYOPHIL GMBH, Hürth (DE)

( * ) Notice: Subject to any disclaimer, the term of this patent is extended or adjusted under 35 U.S.C. 154(b) by 0 days.

(21) Appl. No.: 16/606,966

(22) PCT Filed: Apr. 20, 2018

(86) PCT No.: PCT/EP2018/060206

§ 371 (c)(1),
(2) Date: Oct. 21, 2019

(87) PCT Pub. No.: WO2018/193100

PCT Pub. Date: Oct. 25, 2018

(65) Prior Publication Data

US 2020/0248963 A1 Aug. 6, 2020

(30) Foreign Application Priority Data

Apr. 21, 2017 (EP) ..... 17167643

(51) Int. Cl.
*F26B 5/06* (2006.01)
*F26B 5/04* (2006.01)
(Continued)

(52) U.S. Cl.
CPC ..... *F26B 5/06* (2013.01); *F26B 5/044* (2013.01); *F26B 21/003* (2013.01); *F26B 21/14* (2013.01)

(58) Field of Classification Search
CPC ..... F26B 5/06; F26B 5/044; F26B 21/003; F26B 21/14
(Continued)

(56) References Cited

U.S. PATENT DOCUMENTS 3,270,434 A * 9/1966 Hackenberg ..... F26B 5/06 34/92
3,648,379 A * 3/1972 Mercer ..... A23F 5/32 34/284
(Continued)

FOREIGN PATENT DOCUMENTS

CN 101084406 A 12/2007
CN 101529189 A 9/2009
(Continued)

OTHER PUBLICATIONS

International Search Report and Written Opinion of the International Searching Authority issued in PCT/EP2018/060206, dated Jul. 4, 2018; ISA/EP.
(Continued)

*Primary Examiner* — Stephen M Gravini
(74) *Attorney, Agent, or Firm* — Harness, Dickey & Pierce, P.L.C.

(57) ABSTRACT

The invention relates to a freeze dryer and a method for inducing controlled nucleation in liquid products. The freeze dryer for inducing nucleation in water based products (44) to be freeze-dried comprises a product chamber (12) adapted for housing a vapor gas and the products (44), a condensation chamber (16) connected to the product chamber (12) over an isolation valve (36) in a gas conductive manner, said condensation chamber (16) being provided with a gas pump (18), a gas transfer line (20) connecting the product chamber (12) with at least one cooling device (22) being adapted to generate ice-crystals when said vapor gas is withdrawn from the product chamber through the cooling device (22) in a
(Continued)

Figure 1:
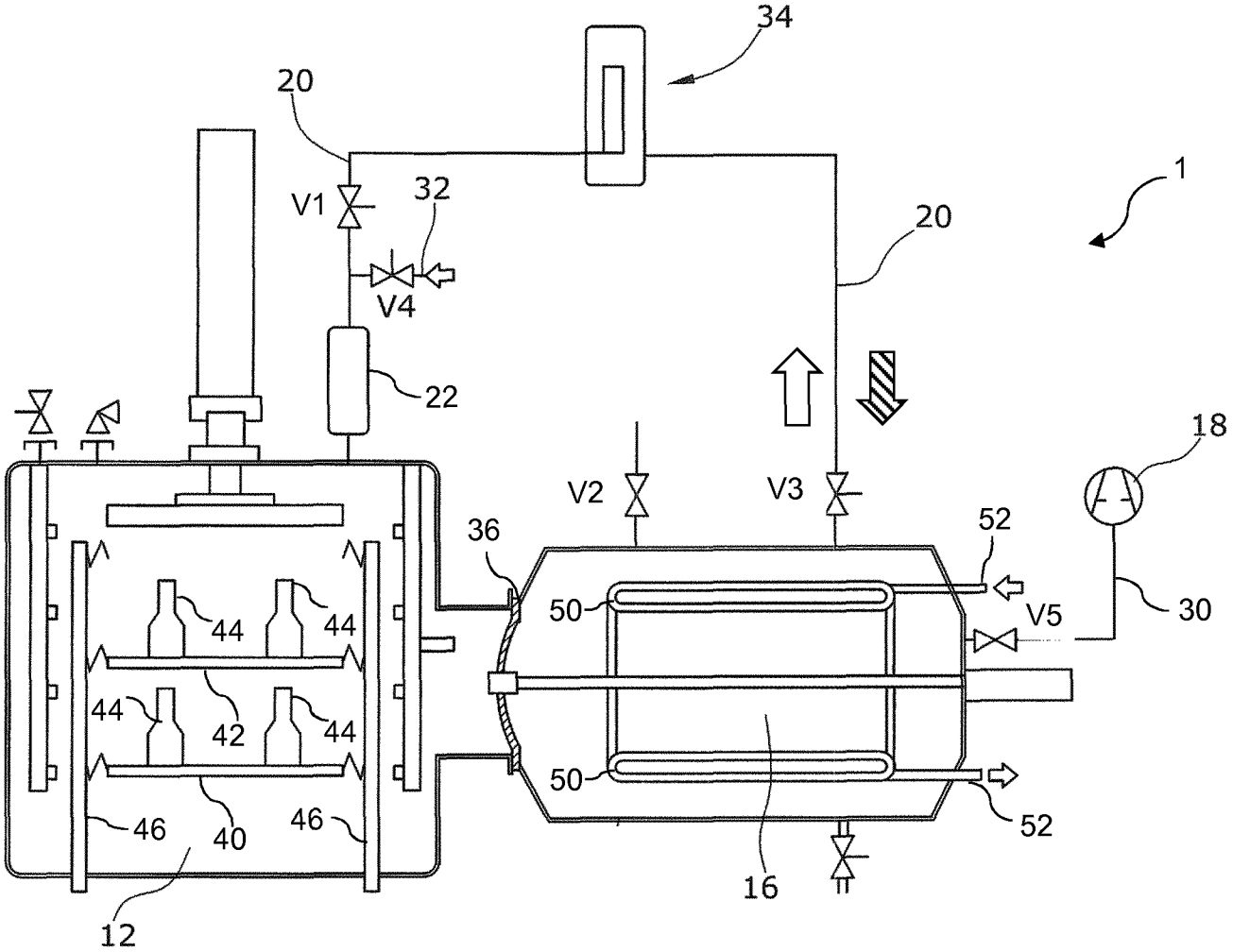

first gas flow direction (streaked arrow), the freeze dryer being adapted to—after the generation of the ice crystals in the cooling device (22)—convey a flushing gas through the gas transfer line (20) in a second gas flow direction (white arrow) going reverse to said first gas flow direction in order to thereby entrain the ice-crystals from the cooling device (22) into the product chamber (12) to induce nucleation of the products (44) therein. The freeze dryer is particular in that the gas transfer line (20), which comprises the cooling device (22), is separated from the gas pump (18) at least by the condensation chamber (16), the condensation chamber (16) providing a gas passage for the withdrawn vapor gas during the withdrawal in the first gas flow direction, and a gas passage and/or gas storage for the flushing gas during the conveying in the second gas flow direction.

19 Claims, 3 Drawing Sheets

(51) Int. Cl.
*F26B 21/00* (2006.01)
*F26B 21/14* (2006.01)

(58) Field of Classification Search
USPC ..... 34/298
See application file for complete search history.

(56) References Cited

U.S. PATENT DOCUMENTS

| | | | | |
|---|---|---|---|---|
| 3,740,860 | A | 6/1973 | Smith, Jr. | |
| 4,016,657 | A * | 4/1977 | Passey | F26B 23/005 34/92 |
| 4,177,577 | A * | 12/1979 | Bird | F26B 5/06 34/92 |
| 5,884,413 | A * | 3/1999 | Anger | F26B 5/06 34/92 |
| 6,199,297 | B1 * | 3/2001 | Wisniewski | B65D 51/241 206/439 |
| 6,920,701 | B2 * | 7/2005 | Haseley | F26B 5/06 34/92 |
| 6,935,049 | B2 | 8/2005 | Alstat | |
| 6,971,187 | B1 * | 12/2005 | Pikal | F26B 5/06 34/285 |
| 7,086,177 | B2 | 8/2006 | Alstat | |
| 7,695,230 | B2 * | 4/2010 | Selch | B65G 1/0435 414/180 |
| 8,015,841 | B2 | 9/2011 | Cheng | |
| 8,240,065 | B2 | 8/2012 | Rampersad et al. | |
| 8,793,896 | B2 * | 8/2014 | Patel | G01N 21/68 34/290 |
| 8,966,782 | B2 * | 3/2015 | Kuu | F25D 17/02 34/287 |
| 9,003,676 | B2 * | 4/2015 | Yarborough | A61M 5/002 34/287 |
| 9,121,637 | B2 * | 9/2015 | Ling | F26B 5/06 |
| 9,435,586 | B2 | 9/2016 | Ling | |
| 9,470,453 | B2 | 10/2016 | Ling | |
| 9,528,761 | B2 * | 12/2016 | Kuu | F25D 17/02 |
| 9,625,210 | B2 * | 4/2017 | Kuu | F25C 1/00 |
| 9,739,532 | B2 * | 8/2017 | Baugh | F26B 5/06 |
| 9,869,513 | B2 * | 1/2018 | Kuu | F26B 5/06 |
| 10,005,621 | B2 * | 6/2018 | Strauch | B65G 47/53 |
| 10,113,797 | B2 * | 10/2018 | Dem | A23F 5/32 |
| 10,451,346 | B1 * | 10/2019 | Nguyen | F26B 5/065 |
| 10,767,925 | B2 * | 9/2020 | Capeder | F26B 3/00 |
| 10,809,003 | B2 * | 10/2020 | De Beer | F26B 25/22 |
| 2003/0121171 | A1 * | 7/2003 | Chou | C23G 5/00 34/406 |
| 2005/0144804 | A1 | 7/2005 | Alstat | |
| 2005/0278973 | A1 | 12/2005 | Alstat | |

FOREIGN PATENT DOCUMENTS

| | | | | |
|---|---|---|---|---|
| CN | 102630293 | A | 8/2012 | |
| EP | 0350515 | A1 | 1/1990 | |
| EP | 3093597 | A1 | 11/2016 | |
| EP | 3392584 | B1 * | 12/2019 | F26B 21/14 |
| JP | 2007517183 | A | 6/2007 | |
| JP | 3983617 | B2 * | 9/2007 | B01D 3/346 |
| KR | 20080003598 | A | 1/2008 | |
| WO | WO-2014/028119 | A1 | 2/2014 | |
| WO | WO-2015/138005 | A1 | 9/2015 | |
| WO | WO-2018193100 | A1 * | 10/2018 | F26B 5/06 |

OTHER PUBLICATIONS

First Office Action regarding Chinese Patent Application No. 201880026363.9, dated Oct. 29, 2020 with English translation.

International Preliminary Report on Patentability Regarding International Application No. PCT/EP2018/060206, dated Oct. 22, 2019.

* cited by examiner

FREEZE DRYER AND A METHOD FOR INDUCING NUCLEATION IN PRODUCTS

The invention refers to a freeze dryer and a method of freeze drying for inducing nucleation in products, i.e. water based products, e.g. vials or syringes filled with a liquid product, such as a biological, pharmaceutic and/or cosmetic product.

Lyophilization, also termed freeze drying, is a scientific and industrially important process of drying biologicals and other water containing products. It is widely used in the preparation of biopharmaceuticals and biologicals because it allows greater storage stability for otherwise labile biomolecules, provides a convenient storage and transporting format, and—following reconstitution—rapidly delivers the product in its original formulation, ready for use.

Products comprising liquid, such as liquid pharmaceuticals or nutrition, are freeze dried in a product chamber of a freeze dryer. Typically, pharmaceutical liquid products are filled in vials which are placed onto stacked plates or shelves within the product chamber. The product chamber is connected to a condensation chamber wherein condensing coils cool down the product chamber and the liquid products therein to low temperatures, i.e. below 0° C. The cooled product chamber is evacuated to a low pressure in the range around and below the triple point, i.e. below 10 mbar and temperatures around and below −40° C. through the condensation chamber of the condenser such that the humidity withdrawn from the product chamber condenses, some of it as ice upon the condensing coils within the condensation chamber, and the products are dried, i.e. the water around and inside the dry content is sublimated directly from the frozen state into a vapor state using a heating system around the products. During conventional industrial batch and continuous freeze drying processes, an isolation valve is provided between the condensation chamber and the product chamber, which valve during this drying process generally is kept open for the passage of sublimated vapor from the vials an into the condensation chamber to be condensed on the condensing coils. In some freeze-dryers, a condense removal cycle is made possible during the freeze drying operation, whereunder parts of the condensation chamber are compartmentalized and are closed off using one or more isolation valves, and the outer surfaces of the condensing coils are cleaned.

For liquid products, an effective freeze drying starts with a uniform initial freezing of the products for producing a more uniform product, because the degree of super-cooling and nucleation temperature is influencing product parameters, for example cake resistance, specific surface area, and residual moisture. Therefore, controlled, i.e. induced substantially simultaneous uniform, ice nucleation of super-cooled solutions has attracted a lot of interest among scientific and industrial pharma companies. A liquid crossing its standard freezing point will crystalize in the presence of a seed crystal or nucleus around which a crystal structure can form creating a solid. Lacking any such nuclei, the liquid phase can be maintained all the way down to the temperature at which crystal homogeneous nucleation occurs, i.e. the liquid is in a super-cooled state. Ice nucleation or nucleation is the process of spontaneous ice crystal formation, in nature often spurred on by the presence of foreign bodies. However, in industrial medication production, using such foreign bodies is not acceptable given the requirements for sterility and cleanliness.

In "Cyclodextrins as Excipients in drying of Proteins and Controlled Nucleation in Freeze Drying", doctor dissertation from Fakultät für Chemie und Pharmazie der Ludwig-Maximilians-Universität, München, 2014, Chapter III, "Controlled Ice Nucleation in Pharmaceutical Freeze-drying" Reimund Michael Geidobler provides an in-depth overview of different nucleation techniques available today, including nucleation using a) ice-fog, i.e. tiny ice-droplets created by a cryogenic gas, b) sudden de-pressurization, c) ultrasound, d) vacuum induced surface freezing, e) gap freezing, f) electro freezing, g) temperature quench freezing, h) precooled shelf, i) mechanical agitation. However, as he mentions, many of these: a) ice-fog, c) ultrasound, d) vacuum induced surface freezing, f) electro-freezing, h) precooled shelf, i) mechanical agitation are difficult to scale up to industrial type plants. Further, in III.3.2.2, he suggests a way of ice nucleation comprising: cooling the product, depressurizing the product chamber to a low pressure—but not crossing the triple point—followed by a pressure increase to atmospheric pressure in the condenser by letting in over-pressurized gaseous nitrogen using a release or drain valve of the condenser chamber. Thereby, ice particles, herein termed ice crystals, are released from frost formed on the condenser surface and carried into the product chamber via an open isolation valve where they trigger the phase change from fluid to solid upon contacting the product. However, this way of ice nucleation is not directly adaptable in the field of industrial production of pharmaceuticals under GMP (Good-Manufacturing-Practices) requirements. The condensation chamber of the freeze dryer itself is classed as not possible to clean to the required extent—therefore no ice crystals being produced therein can be used to enter into any liquid pharmaceutical product.

WO2015138005, U.S. Pat. Nos. 9,435,586, 9,470,453, WO2014028119 all describe methods of controlling nucleation of a product in a freeze dryer. The method of WO2014028119 comprises to maintain the product at a given temperature and pressure, create a volume of condensed frost on an inner surface of a condenser chamber separate from the product chamber and connected thereto by a vapor port, where the condenser chamber has a pressure greater than the one in the product chamber. The vapor port is opened to create air turbulence that breaks down the condensed frost into ice-crystals that rapidly enter into the super-cooled products and creates even nucleation thereof. The condenser chamber is either—see FIG. 1 in WO2014028119—the same as is used for condensing during sublimation in the freeze drying process and the vapor port is the isolation valve; or see FIGS. 2 and 3 a separate nucleation seeding generation chamber [110] with its own separate nucleation valve [124]. As described in this document strong gas turbulence is created in the chamber [110] in order to remove loosely condensed frost on the inner surfaces of the wall therein. Therefore, the method or the freeze dryers disclosed here are not suitable for industrial processes, because—with larger scale freeze dryers—the amount of air flow needed to flush the ice crystals into the vials evenly, when the vapor port opens between nucleation seeding generation chamber and product chamber, would be so significant, it might in fact blow the vials fall over and they would risk to shatter, or hit and damage each other.

EP3093597 also suggests a method for generating the ice particles in either the condenser chamber of the freeze dryer itself (FIG. 1) or in a separate ice chamber (FIG. 2), which is connected to the product chamber and vacuum pump for respective evacuation thereof. In FIG. 2 the separate ice chamber and the product chamber containing the liquid products are directly connected via a gas passage line. The vacuum pump evacuates the product chamber via the chilled ice chamber. Thereby, humid air is extracted from gas in the product chamber as well as the vials containing the liquid product such that moisture from the vials and from the product chamber forms ice crystals within the ice chamber.

Due to the low pressure in the product chamber and the ice chamber, by opening a valve, gas from an external storage, such as atmospheric air or nitrogen, is sucked into the ice chamber such that the gas carries the ice crystals from the ice chamber back into the product chamber and these evenly nucleate the products. The condenser chamber is not taking part in this process of FIG. 2. This process is not directly applicable for industrial type freeze dryers due to two disadvantages: 1) The volume of gas and amount of ice crystals being produced needed for nucleating the larger size industrial product chambers, in the range of 4 to 12 $m^3$ or bigger, requires a larger size separate ice chamber. 2) By providing a gas passage and larger size device external to the freeze-dryer, these new parts need separate approval and classification according to GMP-requirements as well as must be provided vacuum tight, since they are directly connected to the product chamber.

It is an object of the invention to mitigate the above disadvantages and enable controlled ice crystal induced nucleation of products, in particular liquid products, in an industrial sized freeze dryer in particular, but also suitable for freeze dryers under GMP requirements.

The freeze dryer of the invention is defined by any of the claims 1 to 8, and its use thereof by claim 9. The method of the invention is defined by any of the claims 10 to 15.

There is provided a freeze dryer for inducing nucleation in water based products to be freeze-dried, comprising a product chamber adapted for housing a vapor gas and the products, a condensation chamber connected to the product chamber over an isolation valve in a gas conductive manner, said condensation chamber being provided with a gas pump, a gas transfer line connecting the product chamber with at least one cooling device being adapted to generate ice-crystals when said vapor gas is withdrawn from the product chamber through the cooling device in a first gas flow direction, and the freeze dryer being adapted to—after the generation of the ice crystals in the cooling device—convey flushing gas through the gas transfer line in a second gas flow direction going reverse to said first gas flow direction in order to thereby entrain the ice-crystals from the cooling device into the product chamber to induce nucleation of the products therein. These above features may be said to be present in the freeze dryer disclosed in EP3093597, FIG. 2.

According to the present invention the freeze dryer further comprises that the gas transfer line, which comprises the cooling device, is separated from the gas pump at least by the condensation chamber, the condensation chamber providing a gas passage for the withdrawn vapor gas during the withdrawal in the first gas flow direction, and a gas passage and/or gas storage for the flushing gas during the conveying in the second gas flow direction.

This provides for some major advantages:

One being that the gas volume contained in the condensation chamber is sufficient to allow the ice crystals to be flushed from the cooling device into the product chamber after passage and/or storage of the flushing gas in the condensation chamber. No separate gas storage needs to be provided.

A second being that the ice crystals are formed from humidity, preferably originating from the product chamber, being in GMP-terms considered as a process contact surface, requiring a high level of hygienic design, though not as high as e.g. the shelves being defined as product contact surface. The ice crystals are not produced in the condensation chamber, which significantly improves the hygiene of the process, given the fact that the same product fluid for forming the ice crystals is flushed back into the products.

Applicant has realized, by the invention, that a third advantage may be the combined effects of having a) a relatively large volume of flushing gas downstream of the cooling device, b) the cooling device being housed in a relatively small size device, and c) the device, having a smaller size diameter, being connected to and/or ending up into a larger volume product chamber. This result in our opinion in that an effective entrainment action on the ice crystals inside the cooling device is achieved as well as a highly effective distribution of the ice crystals inside the product chamber can be achieved, without any high pressure wind being generated inside the product chamber. It may be that the obtained ratio between low gas transfer line diameter and high product chamber volume reduces the entry turbulence of the flushing gas yet still allows for the pressure difference to draw enough gas volume through the cooling device to entrain a sufficient amount or ice crystals.

In an advantageous embodiment using the condensation chamber as a gas passage or a gas storage for the flushing gas additionally provide for using a cooling facility of the condensation chamber, in an advantageous embodiment such cooling facility comprising the already present cooling ribs therein, to further cool down the flushing gas i.a. to lower the risk that the flushing gas melts any of the ice crystals in the cooling device that are to be flushed into the product chamber.

In an embodiment "Water based products" is defined in its broadest sense, i.e. comprising biological, chemical, natural products wherein any structure, cell, interstice, and/or surface comprises water in a fluid form, i.e. gaseous or liquid. A preferred sub-group of water based products are liquid water based products, e.g. in a solution, such as liquid pharmaceuticals, liquid cosmetics, liquid human food or animal feed, liquid nutraceuticals, liquid chemicals, liquid additives and the like.

In an embodiment "Vapor gas" is defined as a volume of gas comprising a predetermined volume % of water vapor, relative to the water vapor content of gas saturated with water vapor, in the range above 5 vol %, preferably above 10 vol %, more preferred above 25 vol %, even more preferred above 50 vol %, most preferred above 75 vol %. This definition of vol % of water vapor is used throughout this specification.

In an embodiment "Flushing gas" is defined as a volume of gas containing a predetermined volume % of dry gas, i.e. gas comprising water vapor in the range below 50 vol %, preferably below 40 vol %, more preferred below 30 vol %, even more preferred below 20 vol %, most preferred below 10 vol %, and especially below 4 vol %. Some suitable dry gasses are atmospheric air, nitrogen, or the like.

The gas pump connected to the condensation chamber is typically a vacuum pump, preferably it is the same gas pump used for evacuating during freeze drying during sublimation. The term "vacuum" is herein understood as referring to pressures below atmospheric pressure, i.e. below 1000 mbar.

"Valve" is herein to be understood as any suitable pipe opening/closing device for use in a freeze dryer operating under different pressures, such as vacuum, atmospheric pressures, slight over-pressures, i.e. diaphragm valves, ports, check valves, etc.

The condensation chamber provides a gas passage for the withdrawn vapor gas during the withdrawal in the first gas flow direction. Preferably, the gas already in the condensation chamber as well as the vapor gas withdrawn via the gas transfer line and through the condensation chamber is withdrawn with the same gas pump over the condensation chamber. Thereby, a pressure drop is taking place in the product chamber, cooling device, gas transfer line, and condensation chamber, preferably to such an extent that a pressure level around 30 to 6 mbar is achieved in at least the product chamber.

Further, the condensation chamber provides a gas passage and/or gas storage for the conveyed flushing air in the second gas flow direction when this volume of flushing gas is used to entrain the ice crystals in the cooling device. Preferably, the condensation chamber is functioning as a flushing gas storage before opening of a first valve in the gas transfer line, whereby the flushing gas being stored reaches a pressure level around or above atmospheric pressure for an effective flushing and entraining action inside the cooling device.

In an embodiment of the freeze dryer according to the invention, the gas transfer line comprises at least a first valve arranged between the cooling device and the condensation chamber and adapted to close during switching between the first gas flow direction and the second gas flow direction. Having a first valve provided there is enabling the condensation chamber to be used as storage of the flushing gas, before the opening of this first valve, whereafter the condensation chamber is both providing gas passage as well as, preferably, gas storage. If no first valve is provided, the freeze dryer's condensation chamber will function as a gas passage only. During switching, preferably, a fifth valve is closed to keep the low pressure obtained in the condensation chamber if the gas pump is stopped. In an alternative, the first valve is positioned between the cooling device and the product chamber.

Further, in an embodiment of the freeze dryer according to the invention, there is provided a flushing gas supply, i.e. the condensation chamber is connected through at least a second valve to a source of flushing gas, such as dry air or nitrogen, for providing said flushing gas for said gas passage and/or gas storage. Dry air, defined as air containing water vapor in the range below 50 vol %, preferably below 40 vol %, more preferred below 30 vol %, even more preferred below 20 vol %, most preferred below 10 vol % may be provided directly from the external ambient atmospheric air or from a pressurized atmospheric air or nitrogen container. This supply of dry air and said first valve closed is advantageous as this creates a pressure difference, i.e. a higher pressure in the condensation chamber relative to the pressure in the product chamber, which by this stage should be at a low pressure in the range around 30 to 5 mbar. By opening the first valve again when a suitable pressure difference is reached, e.g. atmospheric pressure, or in the range around 950 mbar to above atmospheric, such as pressures up to 1800 mbar is reached in the condensation chamber, this pressure difference ensures that the flushing gas thus stored in the condensation chamber is drawn or conveyed into the gas transfer line and through the cooling device wherein the flushing gas entrains the ice crystals therein and brings them along into the product chamber and nucleates the products.

In an embodiment of the freeze dryer according to the invention, the isolation valve is adapted to be closed during withdrawing of vapor gas from the product chamber and during conveying of flushing gas through the cooling device. Thereby, a withdrawal of vapor gas through the gas transfer pipe in the first gas flow direction is ensured and facilitated, and the conveying of a flushing gas through the cooling device in the second gas flow direction is also ensured and facilitated.

In an embodiment of the freeze dryer according to the invention, the gas transfer line comprises a gas filter arranged between the condensation chamber and the cooling device. A main advantage being that the gas filter can remove any dust, ice fog and/or ice crystals originating from the condensation chamber during the conveying of the flushing gas in the second gas flow direction. This reduces the risk that any non-approved nucleation kernel falls into the products and nucleates, which kernels are not—from a sanitary point of view—approved as being produced in the cooling device suitable therefor. A further advantage is that the risk of any ice crystals being produced in the cooling device follows within the vapor gas in the first gas flow direction and settles inside the condensation chamber is also reduced. Optionally, the gas transfer line also comprises a third valve arranged between the gas filter and the condensation chamber. Thereby, the integrity of the gas filter can be improved due to the possibility of keeping the pressure difference over the gas filter in control. This can be controlled by closing the third valve when the first valve is closing, and opening the third valve when the first valve is opening.

In an embodiment of the freeze dryer according to the invention, the cooling device is directly connected with the product chamber i.e. without interconnection with any valve or port. Thereby, it is ensured that the inner volume of the cooling device is held at the same pressure as there is within the product chamber. This also ensures less risk of loosening the internally produced ice crystals before the flushing gas hits and entrains these during conveying thereof.

In an embodiment of the freeze dryer according to the invention, the cooling device is forming an integral part of the product chamber. Thereby, the cooling device can be provided partly or entirely within the confines of the vacuum approved product chamber. This may require separate classification as a GMP part.

In an embodiment of the freeze dryer according to the invention, the cooling device comprises at least one tubular pipe having an inner cooling surface whereupon the ice crystals are formed and which surface surrounds a pipe volume, the tubular pipe having opposing ends, at least one end being connected to the gas transfer line and forming part thereof. Thereby, tubular pipes, which are already approved as parts of a GMP freeze drying plant, e.g. a 2 inch in diameter pipe called a hygienic pipe may be directly applied inside such cooling device. This eases the GMP-approval of the cooling device. Further, when a flushing gas is conveyed past ice crystals formed on the cooling surface of such tubular pipe this gas can easily entrain the ice crystals, i.e. rip the ice crystals loose from such surface. When the tubular pipe is such a GMP-approved hygienic pipe certain quality of the cooling surface smoothness applies, which eases the entrainability of the ice crystals. A refrigerant, a cooling fluid also called a heat transfer fluid preferably surrounds the cooling surface from an outside thereof in a heat conductive manner in order to cool down the gas within the cooling volume.

In a preferred embodiment thereof, the cooling device comprises multiple tubular pipes arranged within the gas transfer line in parallel AND/OR in series. This increases the cooling power, introduces added redundancy of the cooling device, and increases the amount of ice crystals produced by it. The tubular pipes may be provided in parallel or mixed configuration, or one after the other, which may be an advantage for larger size freeze dryers, where the used dimensions easily accommodate the introduction of several tubular tubes. For smaller size freeze dryers, a parallel or mixed configuration of tubular pipes may be advantageous for a more compact cooling device.

In an embodiment of the freeze dryer according to the invention, the cooling device OR the gas transfer line is provided with a gas inlet comprising a fourth valve for water vapor injection downstream OR upstream of the cooling device. This provides added assurance that a suitable amount of ice crystals can be produced inside the cooling device in that an increased amount of vapor gas reaches the cooling device. Such water vapor may be a vapor gas, or may be an in the field so-called clean steam supply, providing sterile clean water in gaseous or vapor form. In an advantageous embodiment, it is possible to control by exact dosage or by measuring the amount of water added to the process though the fourth valve.

In an embodiment of the freeze dryer according to the invention, it is used for inducing nucleation in products to be freeze-dried, by the steps:

a) cooling the products in the product chamber to a super-cooled state, b) with a gas pump withdrawing a vapor gas via the gas transfer line from the product chamber in a first gas flow direction through the cooling device and then through the condensation chamber while cooling the vapor gas in the cooling device to thereby generate ice-crystals therein, c) conveying a flushing gas in a second gas flow direction reverse to the first gas flow direction from the condensation chamber via the gas transfer line through the cooling device into the product chamber such that the ice-crystals from the cooling device are flushed into the product chamber to induce controlled nucleation of the products therein, where the above steps a), b) and c) are carried out before sublimation of the products is carried out as part of the freeze drying process.

According to the method of the invention of inducing controlled nucleation of water based products to be freeze dried in a freeze dryer it comprises the steps: a) cooling the products in a product chamber of the freeze-dryer to a super-cooled state, b) withdrawing a vapor gas from the product chamber via a gas transfer line in a first gas flow direction through a cooling device and through a condensation chamber of the freeze dryer while cooling the vapor gas in the cooling device to thereby generate ice-crystals therein, c) conveying a flushing gas in a second gas flow direction reverse to said first gas flow direction from the condensation chamber via the gas transfer line through the cooling device into the product chamber such that the ice-crystals from the cooling device are flushed into the product chamber to induce controlled nucleation of the products therein, where the above steps a), b) and c) are carried out before sublimation of the products is carried out as part of the freeze drying process in the freeze dryer.

Thereby, an effective use of a freeze dryer and method of nucleation is suggested, which solves the above disadvantages of the prior art: It is directly applicable to an industrial type and size of freeze dryer as well as laboratory and smaller scale freeze dryers. It allows to be used in a freeze drying plant subjected to GMP-requirements, because the gas transfer line as well as the cooling device may be a component already implemented and approved under GMP-requirements. No ice crystals for nucleation are generated in in the condenser chamber, which under GMP is classed as not able to be sterilized to a high enough degree for ice crystals made here to be used as nucleating kernels. Instead, clean, sterile humidity in the form of vapor gas originating from the sterile product chamber is used for generating the ice crystals.

By the invention, it has been realized that earlier methods suffered from the following disadvantages: A strong wind was needed to entrain the ice crystals in the cooling device, but not strong enough to also physically move the products. Using ice-fog (and not ice-crystals) showed to be difficult in producing a uniform distribution of the nucleation of the products, and would not perform well using strong wind or turbulence, because the ice-fog would then adhere to the sides of the vials and inner surfaces of the product chamber. The strong wind needed for entraining could not be achieved with the smaller ice chamber volumes suggested by e.g. WO2014028119, or by EP3093597. None of these suggests to entrain from a small volume ice generator using a large volume of flushing gas as may be provided when using the condensation chamber as storage/passage. It has also been shown during tests by Applicant, that effective entrainment can be achieved for product chamber volumes around 10 to 12 $m^3$ with a ratio between cooling device volumes and condensation chamber volumes in the range of 0.15 $m^3$/5-8 $m^3$=0.02-0.03.

The steps of the method and use may be performed more than once, if necessary, However, it is preferred to only run the nucleation cycle once and thereby having the freeze dryer dimensioned such, e.g. with the above set ratio, that the required number of ice crystals are produced and entrained to create a uniform and sufficient nucleation of all the products in the product chamber.

In some embodiments, before the cooling device containing the ice crystals is flushed with gas from the condensation chamber, the evacuated condensation chamber is pressurized, preferably using dry air or nitrogen. Thereby, a pressure differential is achieved between the still evacuated product chamber and the pressurized or vented condensation chamber. This pressure differential results in a rapid gas flow of dry gas from the condensation chamber flowing through the cooling device and flushing the ice particles into the product chamber. The product chamber is thereby re-pressurized by approximately 100 to 300 mbar in below five seconds, and preferably below two or three seconds.

The method of the invention is a pre-step for inducing quick and uniform freezing of the product by nucleation of the super-cooled products, before the product chamber is evacuated for heating and sublimating the liquid product during conventional freeze drying. Vapor gas is withdrawn from the product chamber—not originating from sublimation of the product—and cooled down in the cooling device to generate ice crystals therein. Subsequently, gas is blown from the condensation chamber through the cooling device such that the ice crystals are ripped off and flushed into the product chamber where they induce nucleation upon contact with the liquid product.

In an embodiment of the method according to the invention it further comprises that the flushing gas conveyed from the condensation chamber via the gas transfer line is filtered by a gas filter arranged in the gas transfer line between the condensation chamber and the cooling device. The gas filter can remove any particles, ice fog and/or ice crystals originating from the condensation chamber during the conveying of the flushing gas in the second gas flow direction. This reduces the risk that any non-approved nucleation kernel falls into the products and nucleates, which kernels are not—from a sanitary point of view—approved as being produced in the cooling device suitable therefor.

In an embodiment of the method according to the invention it further comprises that the vapor gas being withdrawn from the product chamber is withdrawn with a gas pump connected to the condensation chamber via a vacuum line separate from the gas transfer line. Using the same gas pump as is already present for evacuating during freeze-drying provides the advantages of not requiring separate GMP-approval, not requiring a pump directly onto the gas transfer line, and not increasing the complexity of an industrial freeze dryer. It also reduces the costs of the entire plant.

In an embodiment of the method according to the invention it further comprises an isolation valve connecting the product chamber and the condensation chamber, which isolation valve is closed at least during step b). In that way, vapor gas from the product chamber is only sucked out via the gas transfer line and cooling device therein, not via the open isolation valve.

In an embodiment of the method according to the invention it further comprises that the isolation valve is closed during step c). In that way, the largest amount of flushing gas is conveyed back through the gas transfer line for entraining the largest amount of ice crystals inside the cooling device. In an embodiment of the method according to the invention it further comprises that the isolation valve is closed before step b). The cooling of the products to a super-cooled state is then achieved through direct tray-cooling.

In an embodiment of the method according to the invention it further comprises that the condensation chamber is provided with a flushing gas from a source of dry atmospheric air or nitrogen through a second valve in a filling step before step c) for filling the condensation chamber as a storage of flushing gas. Thereby, sufficient flushing gas volume is provided for the nucleation, using an already available freeze dryer component, namely the condensation chamber, as storage, and during step c) as gas passage of the flushing gas.

In an embodiment of the method according to the invention it further comprises that at least the cooling device is sterilized by conveying hot steam therethrough after operation, at least in a separate step to steps a), b), c) and to the vacuum drying during sublimation. Conventional hot steam sterilization of GMP-approved freeze dryers may be used here, given that in a preferred embodiment of the cooling device the tubular inner pipe is a GMP-approved pipe, suitable for such sterilizing process. Preferably also the product chamber and the gas transfer line are sterilized in such a way, when these are also GMP approved.

In an embodiment of the method according to the invention it further comprises that step a) is performed before or during step b). In order to save time, step a) and b) can be performed simultaneously, isolation valve being closed. Otherwise, step a) can be performed first with isolation valve open, then step b) can be performed with isolation valve closed.

In an embodiment of the method according to the invention it further comprises that the temperature of the cooling surface of the cooling device is ranging between −30° C. and −90° C., preferably between −50° C. and −70° C. during step b), optionally also before and/or after step b). Thereby, an effective build-up of frost as ice crystals on this cooling surface is ensured.

In an embodiment of the method according to the invention further comprising that a controlled and dosed amount of sterile water, preferably in the form of water vapor, is introduced into the cooling device, optionally via a fourth valve, through the gas transfer line, during step c). Hereby it is possible to control that at least a minimum amount of ice crystals generated in the cooling device is introduced into the product chamber.

In an embodiment of the method according to the invention it further comprises that the condensation chamber is cooled down for freeze drying the products only after steps a), b) and c) have been carried out. Thereby the risk that any ice crystals form on any inner surface of the condensation chamber before after the end of the nucleation can be minimized.

In an embodiment of the method according to the invention a dry flushing gas is applied in step c) and said dry flushing gas is cooled in the condensation chamber during step c). Optionally, the dry gas is introduced through a second valve. The dry flushing gas may e.g. be dry air or nitrogen. By cooling the flushing gas any risk is avoided that the flushing gas melts any of the ice crystals in the cooling device. Preferably, the dry gas is sufficiently dry to allow cooling down to −40° C. without formation of ice crystals.

Figure 2:
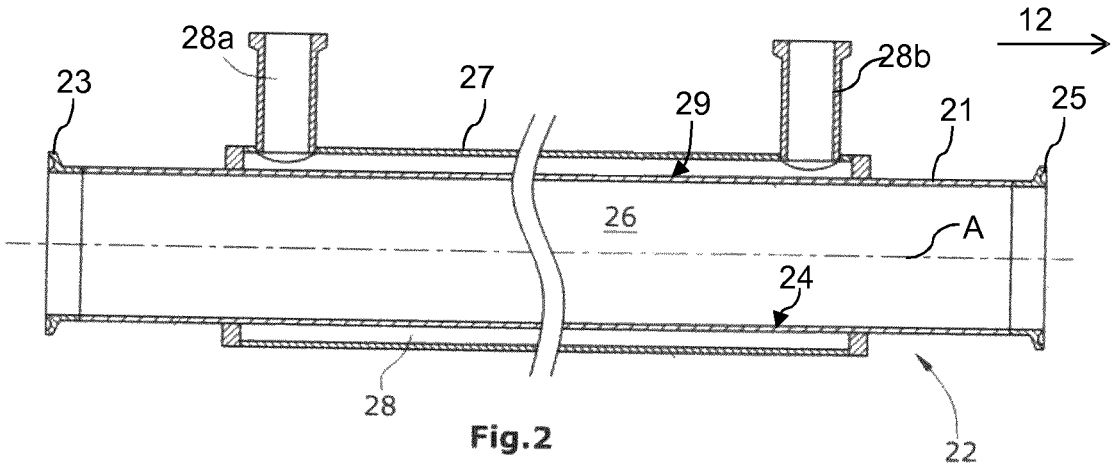

In the following, embodiments of the invention are described with reference to the drawing, where same reference numerals are to reference the same features, comprising FIG. 1 shows a schematic layout of an embodiment of the freeze dryer according to the invention.

Figure 3A:
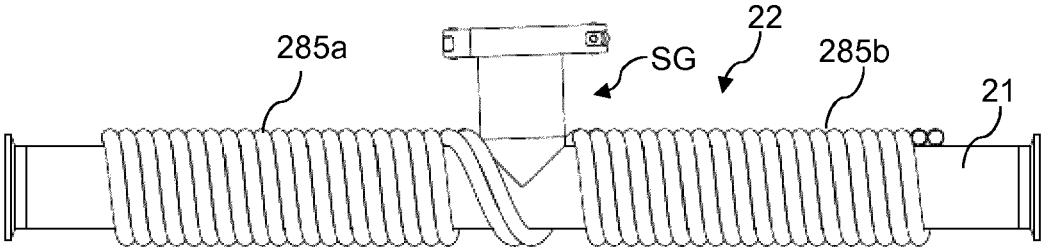
Figure 3B:
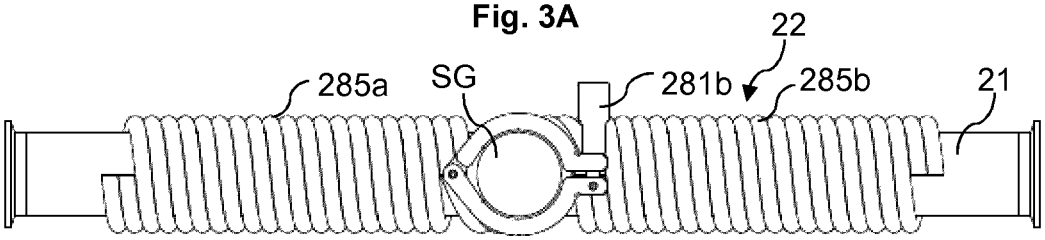
Figure 4A:
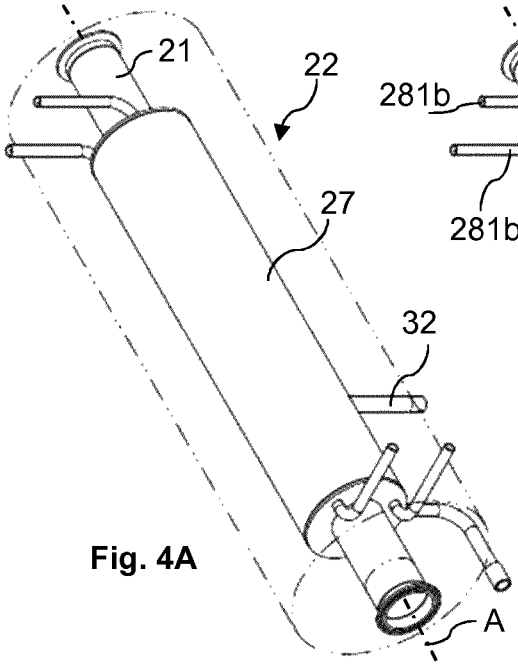
Figure 4B:
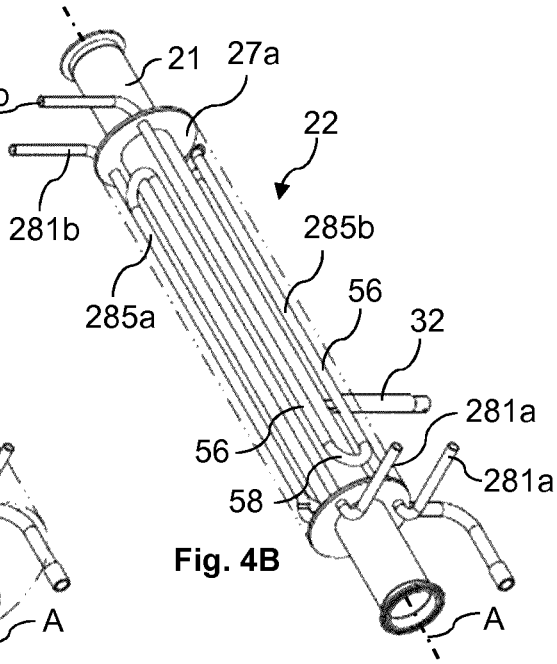

FIG. 2 shows a cross section of a first embodiment of the cooling device,

FIGS. 3*a* and 3*b* show two side views of a second embodiment of the cooling device along its longitudinal extension, FIGS. 4*a* and 4*b* show two 3D views of a third embodiment of the cooling device, with and without outer pipe.

Figure 5A:
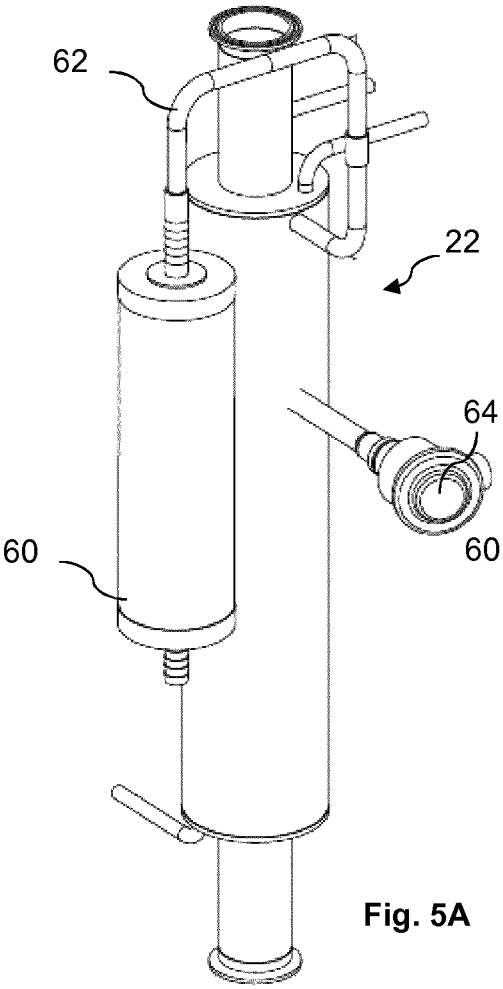
Figure 5B:
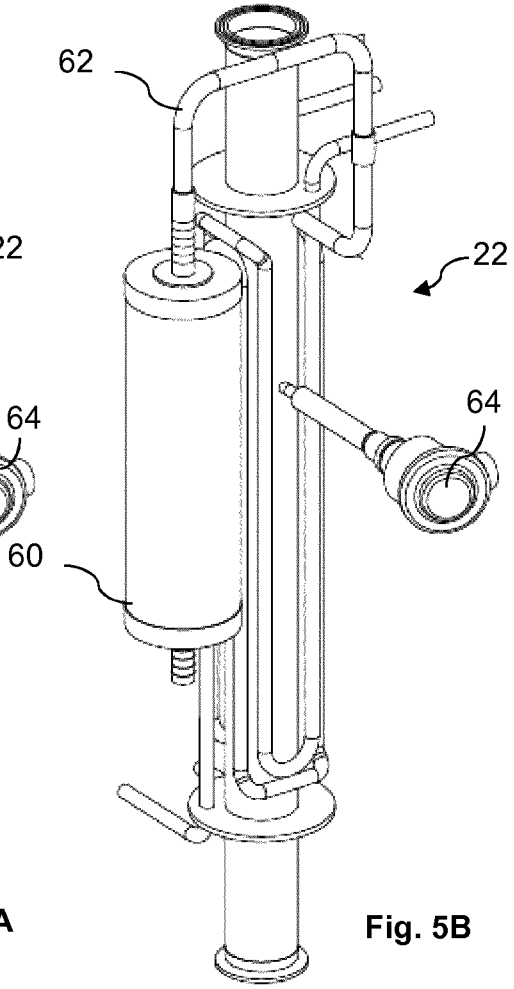

FIGS. 5*a* and 5*b* show two 3D views of a fourth embodiment of the cooling device, with and without outer pipe.

In FIG. 1 is shown a freeze dryer comprising a product chamber 12, which houses stacked shelves 40, 42, on which vials 44 containing a liquid product are arranged. A condensation chamber 16 is directly connected to the product chamber 12 via a gas passage. An isolation valve 36 is provided in a known manner in the form of a mushroom valve to open or close the gas passage; here the isolation valve 36 is shown closed. The condensation chamber 16 comprises condensing coils 50 through which a cooling fluid may be passed, see the small arrows indicating cooling fluid entering and exiting the cooling pipe ends 52 in order to achieve condensation of vapor in any gas contained in the condensation chamber 16. Thereby, the freeze dryer can be operated in a conventional freeze drying cycle comprising 1) freezing of the product using a heating/cooling system 46 2) evacuation to low pressures near vacuum around 1-10 mbar and sublimation under the triple point of water in the frozen product 44 during uniform heating of the products in the vials 44 using heating/cooling system 46. Before freezing and drying, however, there is in the field of liquid product freeze drying a desire to provide a nucleation induction.

In FIG. 1 is shown a freeze dryer according to one embodiment of the invention for inducing nucleation in the products, where the freeze dryer comprises a gas transfer line 20 connecting the product chamber 12 and the condensation chamber 16 in a gas conveying manner. This means that vapor gas can be transported from the product chamber 12 to the condensation chamber 16 via the gas transfer line 20 in a first gas flow direction, indicated by the streaked arrow. Flushing gas, such as dry air, can also be transported or conveyed from the condensation chamber 16 along the gas transfer line 20 into the product chamber 12 in a second gas flow direction, indicated by the white arrow, which direction is oriented opposite to the first gas flow direction.

The gas transfer line 20 comprises a cooling device 22. In FIG. 1 the cooling device 22 is provided on a top part of the freeze dryer. However, the cooling device may also be provided on any side thereof, in a bottom part of the freeze dryer, or even as an integral part of the product chamber 12 and connected to the gas transfer line 20. The gas transfer line 20 also comprises a gas filter 34 and first and third valves V1, V3 adapted to open or close the gas transfer line 20. With regard to the first gas flow direction, the cooling device 22 is arranged downstream of the product chamber 12 and upstream of the first valve V1, while the gas filter 34 is arranged downstream of the cooling device 22 and the first valve V1, and upstream of the condensation chamber 16, the third valve V3 is arranged between the gas filter 34 and the condensation chamber 16, and the first valve V1 arranged between the cooling device 22 and the gas filter 34.

Advantageously, an additional vapor gas inlet 32 is connected with the gas transfer line 20 to supply additional water vapor into the cooling device 22 in case there is not enough vapor gas in the product chamber and from evaporation from the products to produce the necessary amount of ice crystals within the cooling device 22. The gas inlet 32 comprises a fourth valve V4 to open or close the gas inlet 32. The additional water vapor may be injected into the cooling device 22 for generating further ice crystals therein, preferably at an upstream end thereof when vapor gas is flowing in the first gas flow direction.

The condensation chamber 16 has a dry gas inlet valve V2, a second valve, for connecting the condensation chamber 16 to a source of dry gas, such as dry atmospheric air or nitrogen. The second valve V2 provides flushing gas to be stored in or passed by the condensation chamber 16. The second valve V2 is for closing or opening into a dry gas supply (not shown) either ambient atmospheric air or a pressurized nitrogen gas container, or the like. A gas pump 18 in the form of a vacuum pump is connected to the condensation chamber 16 via a vacuum line 30 containing a fifth valve V5.

In the following, an embodiment of a method of inducing controlled nucleation of the products according to the invention is described:

The vials 44 containing a liquid product, such as a vaccine in solution, are placed on trays or shelves 40, 42 within the product chamber 12. The chamber 12 and its contents may be pre-sterilized in a conventional manner. The isolation valve 36 between the product chamber 12 and the condensation chamber 16 may stay closed during all steps of the inventive method or may stay open during cooling the products to a super-cooled state.

The temperature of the cooling device 22 on an inner cooling surface thereof (to be described in detail below) is reduced to a temperature ranging between −30° C. and −90° C., preferably ranging between −50° C. and −70° C.

The products in the product chamber 12 are cooled by having the isolation valve 36 closed and cooling by the heating/cooling system 46 directly via the shelves 40, 42 upon which the vials 44 comprising the liquid product are placed to a super-cooled state, at the atmospheric pressure (as at sea level) and at temperatures around or below 0° C., at which state the product does not freeze without induced nucleation. The temperature at which the product can be kept in a super-cooled state also depends on the type and makeup of the product to be freeze dried. The super-cooled state may preferably be kept for a predetermined time period in order to ensure uniform temperatures is obtained in all the products, in time ranges around 10 to 180 minutes, depending on number and sizes of the vials or containers being in the product chamber.

Some examples of liquid products at atmospheric pressures (at sea level) are:

- A 5% sucrose solution is super-cooled until reaching a temperature of −6° C. or slightly above.
- A 3% mannitol solution is super-cooled until reaching a temperature of −7° C. or slightly above.
- A 1% NaCl, 3% mannitol solution is super-cooled until reaching a temperature of −8° C. or slightly above.

In other words, a super-cooled state in the product is caused to occur. In liquid solutions this often occurs within a temperature range between −5° C. and −10° C. and at atmospheric pressures. This temperature range also applies for other highly water containing products such as biologicals and biopharmaceuticals, e.g. coagulation factors, cellular-derived vaccines, immunoglobulins, biotechnological products, monoclonal antibodies growth factors, cytokines, recombinant vaccines, proteins, collagen, and the like. The freeze dryer and method for inducing nucleation may also be applicable for other water rich products such as seafood, soups, fruits, meat, or the like.

The isolation valve 36 is now closed or kept closed. Then vapor gas from the product chamber 12 is withdrawn via the gas transfer line 20 into the cooling device 22 to generate ice-crystals therein by evacuating over the gas filter 34 and the condensation chamber 16 with the gas pump 18 over the separate vacuum line 30. Alternatively, the vapor gas may be drawn out of the product chamber 12 during the cooling of the products to a super-cooled state. A reduced pressure within the product chamber is thereby reached, i.e. in the range below 30 mbar. This is achieved by withdrawing gas from the product chamber 12 via the gas transfer line 20 and through the condensation chamber 16 by the vacuum pump 18 with valves V1, V3, V5 open, while the valve V2 and isolation valve 36 are closed.

The vapor gas being withdrawn from the product chamber 12 for generating the ice crystals with the cooling device 22 originates from a) the natural evaporation of the liquid product within the vials 44,
b) residual humidity or humid gas between the vials 44 and in the product chamber 12.

Optionally, additional humid air may be injected during this withdrawal by clean water vapor injected into or upstream the cooling device 22 via opening valve V4 from a gas inlet 32.

Preferably, the condensation chamber 16 is not cooled down during the withdrawing of vapor gas from the product chamber 12 for forming the ice crystals within the cooling device 22, in order that no ice crystals are formed within the condensation chamber 16.

Once sufficient ice crystals are formed within the cooling device 22, the first valve V1 and third valve V3 are closed and the same pressure level is maintained within the cooling device 22 in its cooling volume as is in the product chamber 12. Alternatively, either first valve V1 or third valve V3 is closed.

Second valve V2 is opened to supply nitrogen (not shown) into the condensation chamber 16 and fill it until atmospheric pressure is reached, after which the second valve V2 is closed again.

First valve V1 and third valve V3 are opened, either simultaneously or preferably first valve V1 and then valve V3, which opens the passage from the condensation chamber 16 to the product chamber 12 through the gas transfer line 20. Fifth valve V5 can be closed to protect the gas pump 18 and keep the low pressure inside the condensation chamber 16, this valve V5 is optional. The hereby build-up pressure differential between the product chamber 12, which is at a pressure below 10 mbar, and the condensation chamber 16, which is at atmospheric pressure or above, results in a powerful flow of dry flushing gas contained within the condensation chamber 16 being conveyed along the gas transfer line 20 through the cooling device 22 and into the product chamber 12. This flow of flushing gas through the cooling device 22 rips of the ice crystals from the cooling surface 24 and flushes these into the product chamber 12. The liquid product starts to nucleate upon contact with ice crystals due to its super-cooled temperature and does so in a uniform way and, tests have shown, substantially immediately and at the same time, which thereby freezes the product in a consistent and uniform way, which provides the owner or operator of the freeze dryer with a high quality dried product exhibiting uniform quality, as well as longer storage stabilities.

While travelling along the gas transfer line 20, the dry flushing gas flows through the gas filter 34 in order to ensure no contaminants are entrained from the condensation chamber 16 via the flushing gas, which thereby maintains the hygiene and sterility of the products and product chamber. Contamination of the liquid product by the flushing gas needs to be avoided, in particular under GMP conditions.

Once the nucleation has been initiated, first valve V1 and third V3 (again alternatively, valve V1 or valve V3) are closed and the isolation valve 36 is opened. The vacuum pump 18 is then used to generate a vacuum within the product chamber 12 and the condensation chamber 16 while the condensation chamber 16 is cooled down to proceed in a manner corresponding to the conventional freeze drying process of liquid products.

FIG. 2 shows a first embodiment of the cooling device 22. A component of the cooling device 22 is a tubular pipe i.e. a longitudinal cylindrical inner pipe 21 comprising an inner volume 26 around the longitudinal pipe axis A. The pipe 21 has a cross section corresponding to the cross section of the gas transfer line 20. In an advantageous embodiment, it forms an integral part of the gas transfer line 20, and in an embodiment, it is a GMP-approved type hygienic two inch diameter pipe being 500 mm long. The inner pipe 21 has two opposing ends 23, 25 each of which is connected, either mechanically or by welding, to respective portions of the gas transfer line 20, as shown in Fig. Alternatively, only one of these ends 23, 25 is connected to the gas transfer line 20 and other end is connected to the product chamber 12, or in an embodiment the inner pipe 21 forms an integral part of the gas transfer line 20, or forms a pipe part thereof. Vapor gas, when flowing or being conveyed through the gas transfer line 20 in the first gas flow direction inside the inner volume 26 of the inner pipe 21 may then enter the cooling device 22 at the second end 25 and leave at the first end 23. The cooling device 22 comprises a cooling surface 24 that surrounds the inner volume 26, and provides cooling when a cooling medium flows behind the cooling surface 24, see more information below. Thereby the vapor in the gas condenses as water droplet on this surface 24, which droplets turn into ice crystals due to the continued cooling from the surface 24.

When a flushing gas enters in a second gas flow direction in reverse to the first gas flow direction the flushing gas will enter the inner pipe 21 at the first end 23, flow through the inner pipe inside said inner volume 26 and exit at the second end 25 from where it is conveyed into the product chamber 12. The inner pipe 21 surrounds the inner volume 26 in which the vapor gas was being deposited as ice crystals and in which the flushing gas is flushing down along and inside the deposited ice crystals. The inner volume 26 is surrounded by the cooling surface 24 which is the inner surface of the inner pipe 21. When flowing through the inner pipe 21, the gas flows along the cooling surface 24 which takes the thermal energy from the gas to cool the same down. The cooling surface 24 is kept continuously cooled at least during the nucleation process. Alternatively, the cooling surface 24 may only cool until after vapor gas has entered and condensed to ice crystals.

The thermal energy taken from the vapor gas withdrawn against the cooling surface of the inner cooling volume 26 may be guided away according to different alternatives. FIG. 2 shows an outer cylindrical pipe 27 surrounding the inner pipe 21 and defining an outer volume 28 through which a cooling medium, such as liquid nitrogen, is passed. The cooling medium is conveyed along the outer surface 29 of the inner pipe 21 where it draws along the thermal energy from the inner pipe 21 and the vapor gas therein, respectively. The thermal energy is continuously guided away by a continuous flow of cooling medium through the outer volume 28. The cooling medium enters the outer volume 28 through an entry port 28*a* and leaves the outer volume 28 through an exit port 28*b*, using not shown cooling medium pumps.

FIGS. 3A and 3B show a second embodiment of the cooling device 22. Two redundant cooling coils 285*a*, 285*b* are provided in a circumferential direction in the shape of two helical coils, one on each side of a sight glass SG provided centrally along the longitudinal direction of the inner pipe 21. The two coils 285*a*, 285*b* are provided within the outer volume 28 between the outer pipe 27 (not shown in FIGS. 3A and 3B) and the inner pipe 21. However, the skilled person can apply his knowledge and provide only one such coil, or more than two such cooling coils. By providing at least two cooling coils, one of these may fail but the cooling device 22 still provide a cooled surface 24 within the cooling device 22.

FIGS. 4*a* and 4*b* show a third embodiment of the cooling device 22. FIG. 4*a* shows the encapsulated state of the cooling device 22 in which the outer volume 28 is surrounded by an outer pipe 27. FIG. 4*b* shows the cooling device 22 with a removed outer pipe 27 in order to show further details of the cooling device 22.

As shown in FIGS. 4*a* and 4*b*, one or more cooling coils 285*a*, 285*b* may be located within the outer volume 28 located between the inner pipe 21 and the outer pipe 27 (not shown in FIG. 4B). The cooling medium flows through the cooling coils 285*a*, 285*b*, preferably in a continuous manner and thereby continuously cools down any gas within the inner pipe 21. A heat transfer medium may advantageously be provided between outer pipe 27 and inner pipe 21 within the outer volume 28 and surrounding the cooling coils 285*a*, 285*b*. The heat transfer medium may be a silicon oil.

The cooling coils 285*a*, 285*b* are preferably provided with longitudinal coil elements 56 arranged in parallel to the longitudinal axis A of the inner pipe 21. Two longitudinal coil elements 56 are arranged next to each other in a circumferential direction, and likewise on the opposite longitudinal side thereof. Adjacent coil elements 56 are connected by U-shaped elements 58 at their connecting ends. Thereby, the cooling medium is guided along the inner pipe 21 mostly in a longitudinal direction parallel to the inner pipe 21, rather than in a circumferential direction as in case of a helical coil, see FIGS. 3A and 3B. This achieves a homogeneous temperature distribution along and across the entire length of the inner pipe 21 and thereby improves the heat transfer.

A redundancy is achieved by the provision of at least two separate cooling coils 285*a*, 285*b*. Longitudinal coil elements 56 of different cooling coils 285*a*, 285*b* are preferably arranged adjacently, such that longitudinal coil elements of different coil 285*a*, 285*b* alternate in a circumferential direction. The cooling distribution is thereby improved, and even in case of a failure of a coil circuit, a homogeneous cooling distribution can be achieved with the remaining circuit or circuits, respectively.

FIGS. 5A and 5B show a fourth embodiment of the cooling device 22. The outer volume 28 is connected to a heat transfer medium inlet 62 and connected to a filter 60. The heat transfer medium, such as silicone oil, often expands during heating such as under sterilization of the gas transfer line 20 and inner pipe 22. The filter 60 is a moisture filter to let air out and in freely in the volume 28 without any risk that water enters into in the medium by sucking wet air back. FIG. 5A shows the encapsulated state of the cooling device in which the outer volume 28 is surrounded by the outer pipe. FIG. 5B shows the cooling device 22 with removed outer pipe in order to better show the positioning of the cooling coils, which are the same as for the embodiment shown in FIGS. 4B and 4B. Further, a temperature probe 64 is provided, which adjusts and controls the temperature of the heat transfer medium.

The invention claimed is:

1. Freeze dryer for inducing nucleation in water based products to be freeze-dried, comprising a product chamber for housing a vapor gas and the products, a condensation chamber connected to the product chamber over an isolation valve in a gas conductive manner, said condensation chamber being provided with a gas pump, a gas transfer line connecting the product chamber with at least one cooling device generating ice-crystals when said vapor gas is withdrawn from the product chamber through the cooling device in a first gas flow direction, and the freeze dryer —after the generation of the ice crystals in the cooling device—conveying a flushing gas through the gas transfer line in a second gas flow direction going reverse to said first gas flow direction in order to thereby entrain the ice-crystals from the cooling device into the product chamber to induce nucleation of the products therein, wherein the gas transfer line, which comprises the cooling device, is separated from the gas pump at least by the condensation chamber, the condensation chamber providing a gas passage for the withdrawn vapor gas during withdrawal in the first gas flow direction, and a gas passage and/or gas storage for the flushing gas during conveying in the second gas flow direction.

2. The freeze dryer according to claim 1, where the gas transfer line comprises at least a first valve closing during switching between the first gas flow direction and the second gas flow direction.

3. The freeze dryer according to claim 2, where the first valve is arranged between the cooling device and the condensation chamber.

4. The freeze dryer according to claim 1, where the condensation chamber is connected through at least a second valve to a source of flushing gas, such as dry air or nitrogen, for providing said flushing gas for said gas passage and/or gas storage.

5. The freeze dryer according to claim 1, where the gas transfer line comprises a gas filter arranged between the condensation chamber and the cooling device, optionally also comprising a third valve arranged between the gas filter and the condensation chamber.

6. The freeze dryer according to claim 1, where the cooling device is directly connected with the product chamber without interconnection with any valve or port.

7. The freeze dryer according to claim 1, where the cooling device comprises at least one tubular pipe having an inner cooling surface whereupon the ice crystals are formed and which surface surrounds a pipe volume, the tubular pipe having opposing ends, at least one end being connected to the gas transfer line and forming part thereof.

8. The freeze dryer according to claim 1, where the cooling device comprises multiple tubular pipes arranged within the gas transfer line in parallel AND/OR in series.

9. The freeze dryer according to claim 1, where the cooling device OR the gas transfer line is provided with a gas inlet comprising a fourth valve for clean water vapor injection upstream OR downstream of the cooling device.

10. Using a freeze dryer according to claim 1 for inducing nucleation in products to be freeze-dried, wherein the steps:

a) cooling the products in the product chamber to a super-cooled state, b) with a gas pump withdrawing a vapor gas via the gas transfer line from the product chamber in a first gas flow direction through the cooling device and then through the condensation chamber while cooling the vapor gas in the cooling device to thereby generate ice-crystals therein, c) conveying a flushing gas in a second gas flow direction reverse to the first gas flow direction from the condensation chamber via the gas transfer line through the cooling device into the product chamber such that the ice-crystals from the cooling device are flushed into the product chamber to induce controlled nucleation of the products therein, where the above steps a), b) and c) are carried out before sublimation of the products is carried out as part of a freeze drying process.

11. A method of inducing controlled nucleation of water based products to be freeze dried in a freeze dryer, comprising the steps:

a) cooling the products in a product chamber of the freeze-dryer to a super-cooled state b) withdrawing a vapor gas from the product chamber via a gas transfer line in a first gas flow direction through a cooling device and through a condensation chamber of a freeze dryer while cooling the vapor gas in the cooling device to thereby generate ice-crystals therein, c) conveying a flushing gas in a second gas flow direction reverse to said first gas flow direction from the condensation chamber via the gas transfer line through the cooling device into the product chamber such that the ice-crystals from the cooling device are flushed into the product chamber to induce controlled nucleation of the products therein, where the above steps a), b) and c) are carried out before sublimation of the products is carried out as part of a freeze drying process in the freeze dryer.

12. The method according to claim 11, further comprising that the flushing gas conveyed from the condensation chamber via the gas transfer line is filtered by a gas filter arranged in the gas transfer line between the condensation chamber and the cooling device.

13. The method according to claim 11, further comprising that the vapor gas being withdrawn from the product chamber is withdrawn with a gas pump connected to the condensation chamber via a vacuum line separate from the gas transfer line.

14. The method according to claim 11, further comprising an isolation valve connecting the product chamber and the condensation chamber, which isolation valve is closed at least during step b) and/or the isolation valve is closed during step c), and/or the isolation valve is also closed before step b).

15. The method according to claim 11, further comprising that at least one of the cooling device; the product chamber; and the gas transfer line is sterilized by conveying hot steam therethrough after operation, at least in a separate step to steps a), b), c) and to the vacuum drying during sublimation.

16. The method according to claim 11, further comprising that the temperature of a cooling surface of the cooling device ranges between −30° C. and −90° C. during step b), optionally also before step b).

17. The method according to claim 11, further comprising that a controlled and dosed amount of sterile water, preferably in the form of water vapor, is introduced into the cooling device, optionally via a fourth valve, through the gas transfer line, during step c).

18. The method according to claim 11, further comprising that a dry flushing gas is applied in step c), optionally through a second valve, and that said dry flushing gas is cooled by condensing coils in the condensation chamber during step c).

19. The method according to claim 11, further comprising that the temperature of a cooling surface of the cooling device ranges between −50° C. and −70° C. during step b), optionally also before step b).

* * * * *